US005149595A

United States Patent [19]

Kojo et al.

[11] Patent Number: 5,149,595

[45] Date of Patent: Sep. 22, 1992

[54] CERMET ALLOY AND PROCESS FOR ITS PRODUCTION

[75] Inventors: Katsuhiko Kojo; Akibumi Negishi, both of Saitama; Hisaaki Ida, Chiba, all of Japan

[73] Assignees: Hitachi Metals Ltd.; Hitachi Tool Engineering Ltd., both of Tokyo, Japan

[21] Appl. No.: 757,752

[22] Filed: Sep. 11, 1991

[30] Foreign Application Priority Data

Sep. 12, 1990 [JP] Japan ..... 2-241519
Jun. 3, 1991 [JP] Japan ..... 3-159967

[51] Int. Cl.[5] ..... B22F 3/00

[52] U.S. Cl. ..... 428/552; 75/228; 75/236; 75/238; 75/239; 75/240; 75/241; 75/242; 75/244; 419/12; 419/13; 419/14; 419/15; 419/16; 419/17; 419/18; 420/6; 428/408; 428/698

[58] Field of Search ..... 420/6; 75/228, 236, 75/238, 239, 240, 241, 242, 244; 419/12, 13, 14, 15, 16, 17, 18; 428/552, 408, 698

[56] References Cited

U.S. PATENT DOCUMENTS 3,647,401 3/1972 Meadows ..... 75/203
3,660,050 5/1972 Iler et al. ..... 75/204
4,923,512 5/1990 Timm et al. ..... 75/239

*Primary Examiner*—Stephen J. Lechert, Jr.
*Attorney, Agent, or Firm*—Sughrue, Mion, Zinn, Macpeak & Seas

[57] ABSTRACT

A cermet alloy having a structure comprising a hard phase and a bonding phase, said hard phase comprising (1) at least one of MC, MN and MCN, wherein M is at least one element selected from Ti, Zr, Hf, Th, V, Nb, Ta, Pa, Cr, Mo, U and W and (2) at least one W-Co-B compound; said bonding phase comprising Co. The cermet has superior toughness and hardness, and can be worked by conventional sintering methods. The invention also includes a method for producing the cermet.

26 Claims, 9 Drawing Sheets

CERMET ALLOY AND PROCESS FOR ITS PRODUCTION

FIELD OF THE INVENTION

The present invention relates to a cermet alloy useful as a material for tools, that is easily sintered and has extremely high hardness.

BACKGROUND OF THE INVENTION

A cermet alloy is a composite material combining the hardness characteristics of carbide and nitride, etc., with the toughness of metal. Ordinarily, the metal is present in the composite material in the form of a bonding phase and the carbide and nitride, etc., are present as hard particles.

The hard particles include carbides such as TiC (titanium carbide) and WC (tungsten carbide), etc., nitrides such as $Si_3N_4$ and TiN, etc., and borides such as TiB and WB, etc. Cermet alloys of TiC-Ni, Tic-WC-Co, TiC-WC-Co and TiC-WC-Co-Ni in which Ni or Co (cobalt) bonds these particles, and cermet alloys with this TiC replaced with TiCN, are well known.

In the ordinary case of cermet alloy production, its toughness is reduced when selection of the materials and the blending method are chosen to attain better hardness, but on the contrary, its hardness declines when aiming at better toughness. For example, in the case of the TiC-WC-Co group, if the content of Co is reduced, its hardness is improved while its toughness is adversely affected. Also, when the Co content is reduced, sintering will be difficult making it impossible to achieve the required density. On the contrary, when Co content is increased, its toughness is improved but hardness is affected, and also density by the conventional production methods is reduced, making it necessary to use a special sintering process under pressure such as hot pressing and hot isostatic pressing (HIP), etc., thus making the production process much more complicated.

SUMMARY OF THE INVENTION

One object of the present invention is to provide a cermet alloy having superior hardness without reduced toughness.

Another object of the invention is to provide a cermet alloy that is easily sintered, and that does not require a special sintering process such as hot pressing or hot isostatic pressing to achieve sufficient density.

A further object of the invention is to provide a cermet suitable for high density sintering under conditions of decompression or normal pressure.

An additional object of the present invention is to provide a cermet alloy with superior hardness, equivalent to that of a ceramic tool.

A further object of the present invention is to provide a method for making such a cermet alloy.

It has now been found that these and other objects of the invention are attained by a cermet alloy having a structure comprising a hard phase and a bonding phase, said hard phase comprising (1) at least one of MC, MN and MCN, wherein M is at least one element selected from Ti, Zr, Hf, Th, V, Nb, Ta, Pa, Cr, Mo, U and W and (2) at least one W-Co-B compound; said bonding phase comprising Co.

The present invention also includes a method for producing this cermet alloy by the steps of (a) uniformly mixing (1) 10 to 45 vol% of a powder comprising WB; (2) 5 to 20 vol% of a powder comprising Co; and (3) the balance being a powder comprising at least one of MC, MN and MCN, wherein M is at least one element selected from Ti, Zr, Hf, Th, V, Nb, Ta, Pa, Cr, Mo, U and W; (b) forming the mixture into green body; and (c) sintering the green body at a temperature of 1,300 to 1,600 ° C for 10 to 120 minutes.

DETAILED DESCRIPTION OF THE INVENTION

Figure 1:
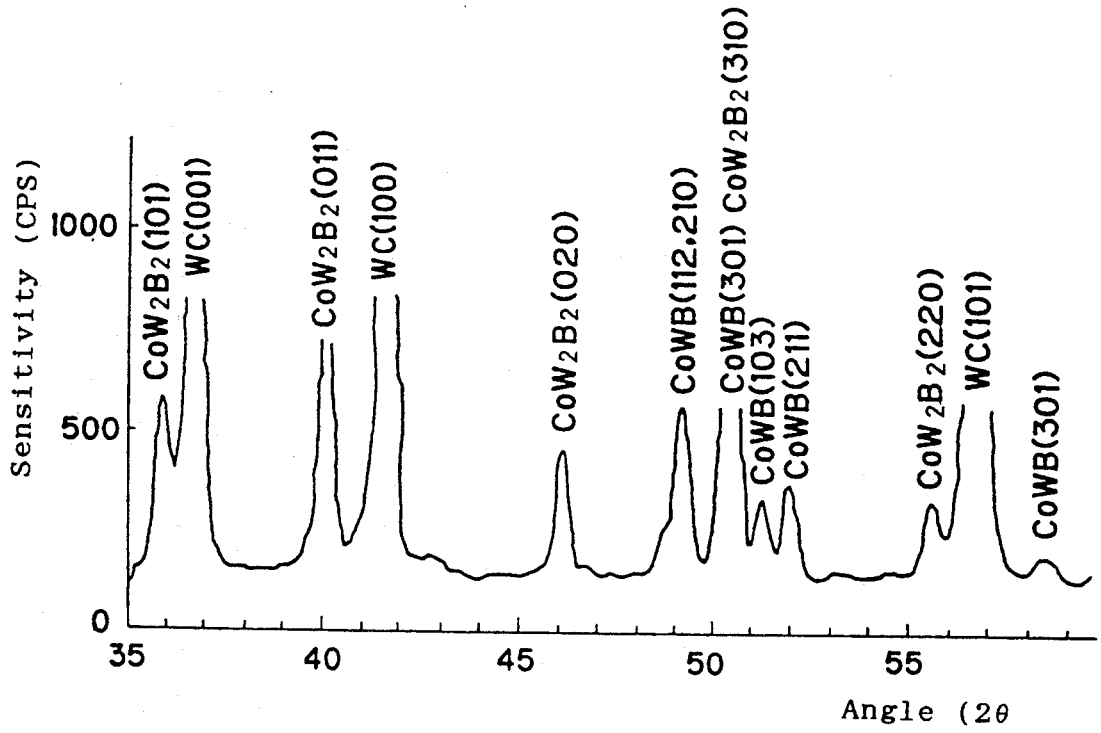
FIG. 1 shows the X-ray diffraction analysis for the sintered structure of Example 1.

The cermet according to the invention is produced by blending and sintering a powder of WB, metallic Co powder and at least one powder of MC, MN and MCN (where M is at least one transitional metal element of Group *4a*, *5a* or *6a* of the Periodic Table). The cermet contains a hard phase with (1) at least one of MC, MN and MCN as its main component, in combination with (2) a W-Co-B component, bonded by a bonding phase containing Co. In particular, M preferably represents Ti, Zr, Hf, V, Nb, Ta, Cr, Mo or W; and is more preferably Ti, W, Mo, Ta and Nb.

The cermet produced by blending and sintering the powders of WB, Co and at least one of MN and MCN, has excellent toughness and hardness, and a structure with the following characteristics:

(1) The hard phase composed mainly of at least one of MC, MN and MCN contains at least one of MC, MN and MCN and (M,W)(B,C) and/or (M,W)(B,N) and/or (M,W)(B,CN); and is composed of a core containing at least one of MC, MN and MCN and a surrounding shell structure containing (M,W)(B,C) and/or (M,W)(B,N) and/or (M,W)(B,CN).

(2) In many cases, the hard phase with a W-Co-B compound as the main component contains CoWB and $CoW_2B_2$, and has a composite core/shell structure consisting of a core of $CoW_2B_2$ and a surrounding structure of CoWB.

It is preferred that the metallic Co in the above bonding phase is 7% or less by weight. The hardness of the alloy is reduced when the metallic Co which does not contribute to the formation of the W-Co-B compound exceeds 7% by weight.

The cermet alloy according to the invention includes a structure having a hard phase and a bonding phase, where the hard phase contains (1) at least one of MC, MN and MCN; (2) at least one of (M,W)(B,C), (M,W)(B,N), (M,W)(B,CN); and (3) a W-Co-B compound; and the bonding phase contains.

In this embodiment the hard phase containing at least one of MC, MN and MCN and at least one of (M,W)(B,C), (M,W)(B,N) and (M,W)(B,CN) may be composed of particles having a composite core/shell structure, containing a core of at least one of MC, MN and MCN and a surrounding structure of one of (M,W)(B,C), (M,W)(B,N) and (M,W)(B,CN).

The present invention also includes a cermet alloy having a structure with a hard phase and a bonding phase, where the hard phase contains (1) at least one of MC, MN and MCN and (2) a W-Co-B compound containing CoWB and $CoW_2B_2$; and the bonding phase contains Co.

The present invention includes a cermet alloy having a structure composed of a hard phase and bonding phase, where the hard phase contains (1) at least one of MC, MN and MCN; (2) at least one of (M,W)(B,C), (M,W)(B,N), and (M,W)(B,CN); and (3) a W-Co-B compound containing CoWB and $CoW_2B_2$; and the bonding phase contains Co.

In a preferred embodiment, the cermet alloy of the invention has a structure composed of a hard phase and a bonding phase, the hard phase containing (1) TiC, (2) (Ti,W)(B,C) and (3) a W-Co-B compound; and the bonding phase contains Co.

The present invention also includes a cermet alloy having a structure composed of a hard phase and a bonding phase, the hard phase containing (1) TiC and (2) a W-Co-B compound containing CoWB and $CoW_2B_2$; and the bonding phase contains Co.

Another preferred embodiment according to the present invention is a cermet alloy having a structure composed of a hard phase and a bonding phase, the hard phase containing (1) TiC, (2) (Ti,W)(B,C) and (3) a W-Co-B compound containing CoWB and $CoW_2B_2$; and the bonding phase contains Co.

Another preferred embodiment of the present invention is a cermet alloy having a structure including a hard phase containing (1) WC and (2) a W-Co-B compound; and a bonding phase containing Co, wherein the content of Co of the bonding phase is 3.5 wt % or less.

The present invention also includes a cermet alloy having a structure composed of a hard phase containing (1) WC and (2) a W-Co-B compound, wherein the W-Co-B compound contains (1) CoWB or (2) CoWB and $CoW_2B_2$; and the bonding phase contains Co.

The cermet alloy of the invention includes a structure composed of a hard phase containing (1) WC and (2) a W-Co-B compound containing (a) CoWB or (b) CoWB and $CoW_2B$,; and a bonding phase containing Co, wherein the content of Co of the bonding phase is 3.5 wt % or less.

In the present invention the W-Co-B compound that is formed in the process includes a composite core/shell structure having a core of $CoW_2B_2$ and a surrounding shell structure of CoWB.

In the cermet alloy of the invention, TiC and (Ti,W)(B,C) may form a composite core/shell structure consisting of a core of TiC and a surrounding shell structure of (Ti,W)(B,C).

The cermet alloy according to the invention is useful for making a base plate for forming a diamond film. The base plate is a sintered body which has a structure composed of a hard phase and a bonding phase, the hard phase containing (1) WC and (2) a W-Co-B compound; and a bonding phase containing Co, wherein the content of metallic Co of the bonding phase is 2.0 wt% or less. The present invention includes a diamond tool composed of this base plate and a diamond film formed on the surface of the base plate.

The method for making the diamond film includes the microwave plasmas CVD process, for example, using: gas pressure of from 10 to 45 Torr; base temperature of from 750 to 850 ° C.; film forming time of from 4 to 8 hrs.; electric power for microwave of from 2 to 4 kW; and magnetic field strength of from 0 to 1,000 gauss.

The present invention further relates to a method for producing a cermet alloy by the steps of:

(a) uniformly mixing (1) 10 to 45 vol % of a powder comprising WB; (2) 5 to 20 vol % of a powder comprising Co; the balance being a powder comprising at least one of MC, MN and MCN, wherein M is at least one element selected from Ti, Zr, Hf, Th, V, Nb, Ta, Pa, Cr, Mo, U and W and (2) at least one W-Co-B compound; said bonding phase comprising Co;

(b) forming the mixture into green body; and (c) sintering the green body at a temperature of 1,300 to 1,600 ° C. for 10 to 120 minutes.

Preferably, in this method the component represented 7 by MC, MN and MCN is TiC or WC.

In order to produce the cermet according to this invention, it is sufficient to blend and form (1) a powder of at least one of MC, MN and MCN, (2) a powder of WB and (3) a powder of Co, followed by sintering in a non-oxidizing atmosphere.

It is desirable to keep the blending ratio of (1) the powder of at least one of MN and MCN, (2) the powder of WB and (3) powdered Co within the ranges specified in the Table 1.

TABLE 1

| Powder for Blending | Blending Ratio |
|---|---|
| MC, MN and MCN | 30–80 vol % (13.7–58.4 wt %) |
| WB | 15–45 vol % (19.0–65.7 wt %) |
| Co | 5–25 vol % (4.7–20.6 wt %) |

Uniform sintering becomes difficult when Wb exceeds 45 vol % in the same blending ratio, and if Co is less than 5 vol %, strength and plasticity are reduced. Without being bound by theory, it is possible that the formation of the complex layer of W-Co-B compound created by the reaction between WB and Co is inhibited. In addition, when Co is more than 25 vol %, the bonding phase is more than required, resulting in deterioration of the hardness of the cermet alloy. It is most preferred to keep the blending ratio of powdered Co in the range of from 6.0 to 8.0 vol %. In the above table, the wt% indicates the value when TiC is selected as MC.

The composition of the cermet alloy for which TiC is selected as MC in accordance with the above blending ratio is in the ranges indicated in Table 2.

TABLE 2

| Content | Content (wt %) |
|---|---|
| Ti | 3.1–62.5 |
| W | 13.1–70.7 |
| Co | 7.9–21.2 |
| B | 0.5–4.0 |
| C, N, CN | 0.5–25.0 |

When the particle size of the powder is too small, pores tend to be created during the sintering process as the result of increased content of oxygen, and if the size is too big, the sintering process tends to be hampered as the result of weakened activity of the powder. Accordingly, it is preferred that the particle size of the powder of MN and MCN is from 0.5 to 45 μm, and more preferably 0.7 to 10 μm. The particle size of the powder of WB is from 0.8 to 10 μm, and more preferably 1.0 to 5.0 μm. The Co powder preferably has a particle size of from 0.1 to 10.0 μm.

It is possible to sinter the powders to form a sintered cermet body using a pressure-free sintering process. It is appropriate to use a non-oxidizing atmosphere such as nitrogen, argon or a vacuum. Although sintering may be conducted by hot pressing or HIP, a sintered body of high density can be produced without adopting such a pressured sintering process. In the pressure-free sintering process, the sintering temperature is suitably from 1,300 to 1,600 ° C, especially in the range of from 1,400 to 1,600 ° C, and the sintering time is 10 to 120 minutes, especially in the range of from 30 to 90 minutes. It is not desirable to sinter at less than 1,300 ° C because sintering does not sufficiently progress and the pores tend to remain, while it is also not desirable if the temperature exceeds 1,600 ° C, since the particles of the hard phase grow excessively. It is not desirable to sinter for less than 10 minutes, since the pores tend to remain, and it is not desirable to sinter longer than 120 minutes since the growth of particles of hard phase tends to be increased.

In the process of the present invention, Co is melted while the sintering process is in progress, and a fine structure is achieved through an accelerating sintering effect. The composite is created when hard particles are bonded firmly with Co. The Co not only fills the ga between the hard particles of MN and MCN, and the hard particles of WB, but also invades the WB particles to react with WB and form $CoW_2B_2$, and further to form a WB phase on the surface of $CoW_2B_2$. Since such complex phases of the W-Co-B group have an affinity higher than that of the WB mono-phase, the bonding strength between the W-Co-B phase and the Co phase is stronger in the cermet alloy of this invention. In many cases, the W-Co-B complex phase takes the form of a composite core/shell structure consisting of a core portion of CoW,B, and a surrounding surface shell portion at least partially covering the core, consisting of CoWB after the WB particle reacts with Co during the sintering process.

In addition to this, a complex phase made of (M,W)(B,C), (M,W)(B,N), and (M,W)(B,CN) is formed, at least on the surface of the particles of MC, MN and MCN, after a part of the WB reacts with MC, MN and MNC during the above sintering process. This reaction forms the composite core/shell structure of MC, MN and MCN particles consisting of a core portion at least partially surrounded by a surface structure.

In this core/shell structure, the surface portion contains much more W and B than the core structure. Since such a composite structure (i.e., of MC, MN and MCN surrounded by (M,W)(B,C), (M,W)(B,N), (M,W)(B,CN)) has a better affinity with Co than MC, MN and MCN, the composite particles are combined with Co by the (M,W)(B,C) and/or (M,W)(B,N) and/or (M,W)(B,CN) phase. The composite grains have an inclined functional structure with a gradual change toward the side of Co from the MC, MN and MCN core portion, and have an excellent bonding strength.

It is also considered that a sufficiently fine sintered structure can be produced even without use of pressurized sintering processes, through the reaction-smelting of Co and a part of WB during the above sintering process.

Since the bonding strength of both hard particles and the metallic Co matrix phases are extremely strong, the toughness of the cermet alloy in this invention is superior. Also, the use of very hard particles of MC, MN and MCN as the hard phase and formation of a W-Co-B compound by a part of the Co having less hardness after sintering creates excellent hardness of the cermet alloy. The cermet alloy by this invention has Vickers hardness, Hv of at least 1,600, more preferably at least 1,700 and most preferably at least 1,800.

The invention is now illustrated in greater detail with reference to the following specific examples and embodiments, but the present invention is not to be construed as being limited thereto. Unless otherwise indicated, all parts, percents and ratios are by weight.

EXAMPLE 1

WC with a particle size of 0.5 10 μm (for the component selected from MC, MN and MCN); WB with a particle size of 1.0–5.0 μm; and metallic Co with a particle size of 5–10 μm were blended according to the ratio (vol %) indicated in Table 3. By forming this mixture under a pressure of 1,500 kgf/cm$^2$ (approximately $147\times10^6$ Pa) a green body having a size of 10 mm dia.×5 mm thickness was obtained. These green bodies were sintered in a vacuum at the respective temperatures of 1,450 ° C., 1,500 ° C. and 1,550 ° C. for 1 hr. to form a cermet alloy. The Vickers hardnesses Hv (1,450), and crack resistance CR (1,500) and CR (1,550) are shown in parallel in Table 3, and each was determined according to the appropriate Japanese Industrial Standard (JIS Z2244). In the table ICP-Co is the content of metallic Co of the bonding phase as determined by plasma emission analysis. This is the result of analysis of Co in the solution after grinding the sintered structure to less than 352 mesh to get a sample for analysis, then selectively dissolving the metal phase out of it in acid solution and removing non-dissolved powder from the solution with a filter. With this step, analysis can be conducted on the metallic Co remaining in the bonding phase of the sintered structure to ascertain its volume. Sample (11) in the table is a comparative example.

Each cermet according to this invention has a Vickers hardness in excess of 1,700 and excellent crack resistance, since the CR value is also large. Furthermore, the content of metallic Co in the sintered body is less than 2 wt %, thus reducing the quantity of C which inhibits the formation of diamond core during the diamond film formation, and it creates a high density sintered body with a quality good enough to be used as a tool. Sample No. 2 with less WB than Co (Co/WB≧0.8) is not suitable for use as a base plate for diamond film formation because Co in the sintered body is excessive at 3.42 wt%. No. 11 is a comparative example of a cemented carbide which conventionally has been used as the base plate for diamond film formation.

EXAMPLE 3

TABLE 3

| No. | Quantity of Content (vol %) WC | WB | Co | Co (wt %) | Co/WB | Hv (1450° C.) | Hv (1500° C.) | Hv (1550° C.) | CR (1450° C.) | CR (1500° C.) | CR (1550° C.) | ICP-Co (wt %) |
|---|---|---|---|---|---|---|---|---|---|---|---|---|
| 1 | 60 | 30 | 10 | 5.91 | 0.33 | 1760 | 1930 | 1850 | 38.9 | 42.5 | | 0.85 |
| 2 | 80 | 10 | 10 | 5.91 | 1.00 | 1717 | 1600 | 1630 | 55.8 | 64.9 | | 3.42 |
| 3 | 85 | 10 | 5 | 2.89 | 0.50 | | 1790 | 1760 | 39.1 | 41.5 | 38.9 | 0.33 |
| 4 | 55 | 35 | 12 | 5.91 | 0.34 | | 1820 | | | 39.5 | | 0.32 |
| 5 | 58 | 30 | 12 | 7.08 | 0.40 | 1662 | 1850 | 1810 | 39.6 | 46 | 37.2 | 0.52 |
| 6 | 40 | 40 | 20 | 12.38 | 0.50 | 1302 | 1880 | 1680 | | 39.7 | | 0.49 |
| 7 | 70 | 20 | 10 | 5.91 | 0.50 | 1677 | 1790 | 1750 | 38.4 | 49.6 | 35.1 | 0.52 |
| 8 | 55 | 30 | 15 | 9.06 | 0.50 | 1444 | 1820 | 1720 | | 38.8 | 30.3 | 0.46 |
| 9 | 45 | 40 | 15 | 9.06 | 0.38 | 1484 | 1810 | 1830 | | 51.3 | 35.1 | 0.47 |
| 10 | 50 | 30 | 20 | 12.38 | 0.66 | 1700 | 1720 | 1480 | 62.4 | 54 | | 1.63 |
| (11) | 90 | — | 10 | 5.91 | — | 1550 | 1830 | | 75.0 | 36.4 | | 5.77 |

FIG. 1 shows X-ray diffraction analysis of the sintered body for the example of the sintered body of WC with WB-30 vol% and Co-10 vol% at temperature of 1,500 ° C. As is evident from FIG. 1, most of the Co reacts with WB during the sintering process and forms CoW,B, and CoWB which are W-Co-B compounds.

Figure 2:
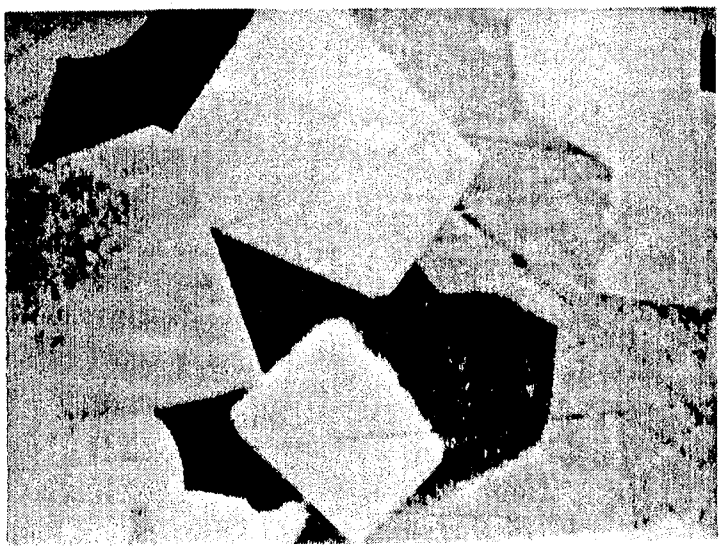
FIG. 2 is an SEM microphotograph (magnification 12,000 times) showing the particle composition of the sintered microstructure of Example 1.

FIG. 2 is an SEM microphotograph showing the microstructure of this sintered body at a magnification of 12,000 times. In FIG. 2, the white particle is WC, the grey particle is $CoW_2B_2$, and the black particle is CoWB. Co as a bonding phase is limited to only about 1 wt %, and is not observed within the visual field.

EXAMPLE 2

A diamond film was formed on the base plate of the above sintered body using a conventional microwave plasma CVD process. The CVD process was conducted with a microwave using an output of 3 kW, a pressure of induced gas of 30 Torr, density of methane in the gas of 0.8% and duration of film formation of 2 hours.

Figure 3:
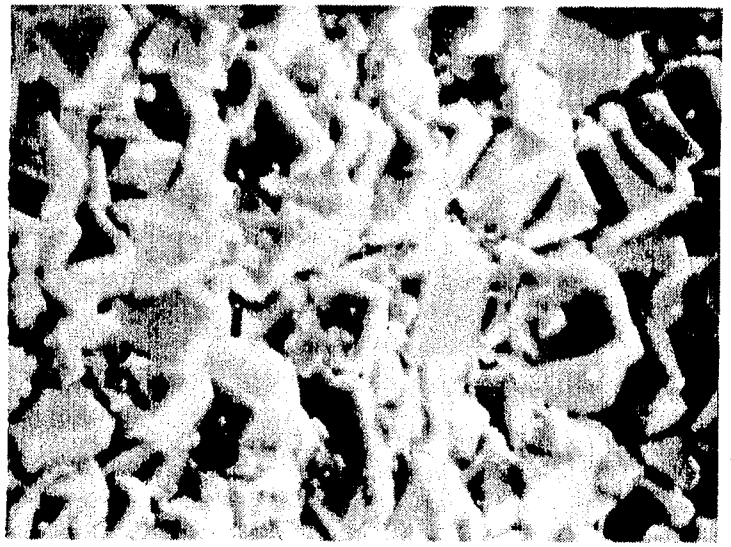
FIG. 3 is an SEM microphotograph (magnification 12,000 times) showing the particle composition of a diamond film on a base plate of the same material as the sintered composition in FIGS. 1 and 2.

FIG. 3 is a photograph showing the particle structure on the base plate after formation of the diamond film and is the result of SEM observation (magnification of 12,000 times). The area shown in FIG. 3 was obtained from the base plate having the same material quality as the structure (Co of WC-30 vol % and WB-10 vol %) shown in FIGS. 1 and 2.

Figure 4:
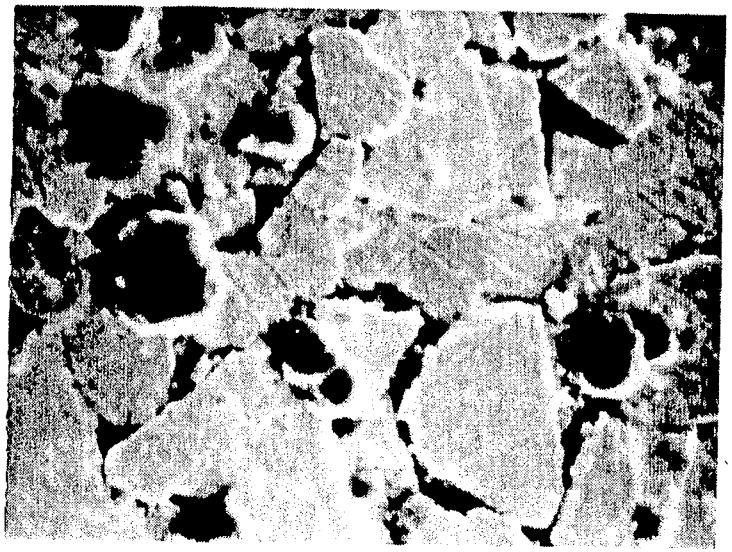
FIG. 4 is an SEM microphotograph (magnification 12,000 times) showing the particle composition after the formation of a diamond film on a base plate made of a conventional cemented carbide.

FIG. 4 is a photograph showing the particle structure on the surface of a base plate after the formation of diamond film by in the same process as above, using a cemented carbide (Co with WC-10 vol%) base plate conventionally used.

As is evident from FIG. 3, when using a cermet alloy base plate, a uniform film with a square or triangular surface (automorphic surface) which is characteristic of a diamond film was obtained. This triangular surface is called a (111) surface and the square surface is a (100) surface. It is generally considered that the crystallinity of diamond formed is better when such an automorphic surface is observed. On the other hand, when using a conventional base plate of cemented carbide, formation of the diamond film is inhibited and particles in the granular state are formed only in part. This may be attributable to the delay in the formation of diamond film caused by rich Co acting as the bonding phase in the case of cemented carbide, which absorbs the carbon constituent of the diamond with resultant buildup of WC.

TiC with a particle size of 0.7 μm as MC, WB with particle size of 0.8 μm and Co with a particle size of 3.0 μm were blended in the ratios indicated in Table 4. Table 4 shows the volume percentages of the element combinations.

TABLE 4

| Powder for Blending | Blending Ratio | Blending Element | Volume of Blending Element |
|---|---|---|---|
| TiC | 60 vol % | Ti | 27.58 wt % |
| | | C | 6.92 wt % |
| WB | 30 vol % | W | 52.07 wt % |
| | | B | 0.03 wt % |
| Co | 10 vol % | Co | 10.4 wt % |

The mixture shown in Table 4 was press-formed at a pressure of 1,500 kg/cm (approximately $147\times10^6$ Pa), and a green body of 10 mm dia.×5 mm thickness was obtained. This green body was sintered in a vacuum at a temperature of 1,450 ° C. for 60 minutes to form a cermet.

Photographs of the microstructure of the cross section of the sintered body of this cermet alloy are shown in FIGS. 5 through 8. The magnification of the SEM micrographs showing the texture in the respective figures was 2,400 times for FIG. 5, 16,000 times for FIG. 6, 20,000 times for FIG. 7 and 75,000 times for FIG. 8.

Figure 5:
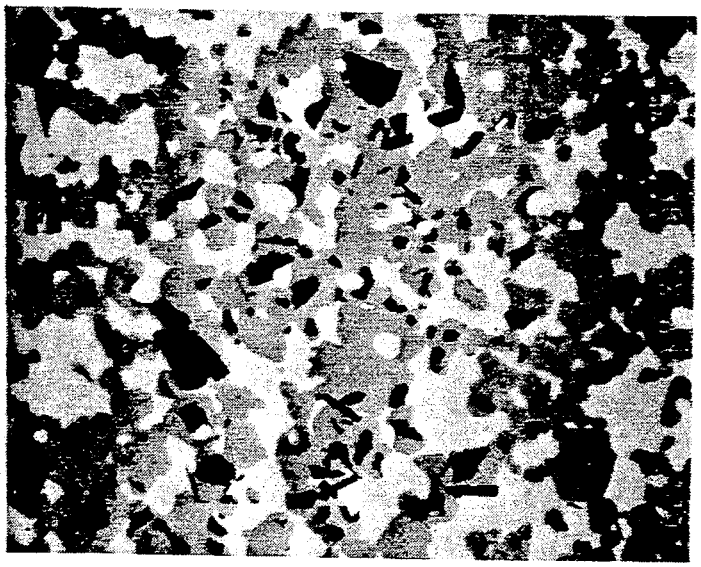
FIG. 5 is an SEM microphotograph (magnification 2,400 times) showing the metallic microstructure of a cermet according to the invention.
Figure 6:
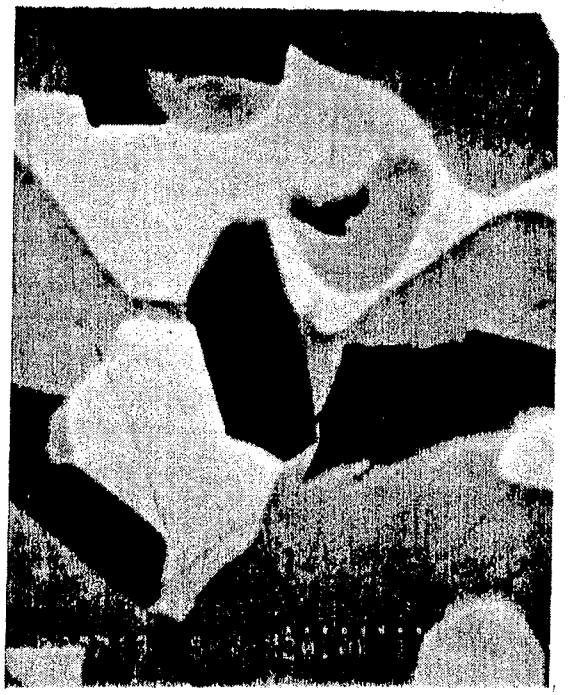
FIG. 6 is an SEM microphotograph (magnification 16,000 times) showing the metallic microstructure of a cermet according to the invention.

As indicated in FIGS. 5 and 6, this cermet alloy had an extremely fine structured sintered body. Its Vickers hardness (Hv) was 2,010.

Figure 7:
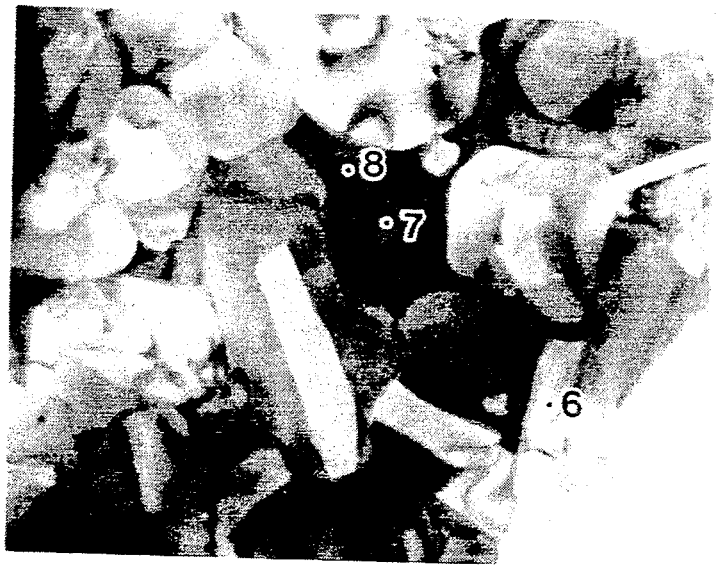
FIG. 7 is an SEM microphotograph (magnification 16,000 times) showing the metallic microstructure of a cermet according to the invention.
Figure 8:
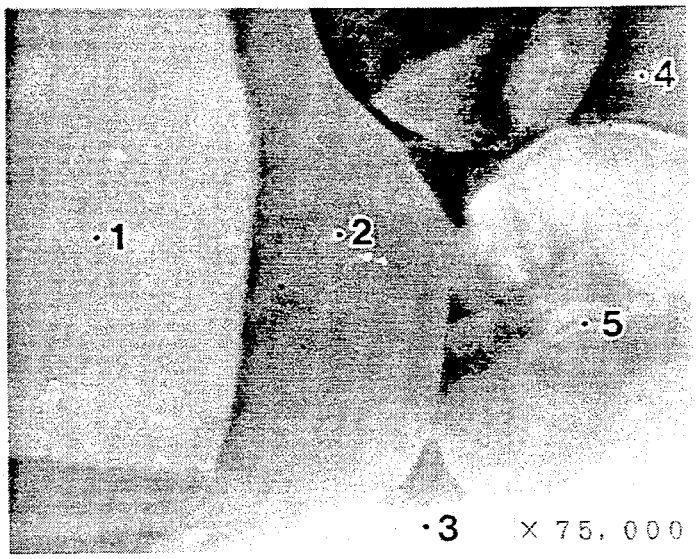
FIG. 8 is an SEM microphotograph (magnification 75,000 times) showing the metallic microstructure of a cermet according to the invention.

Table 5 shows the elemental analysis using an electron microscope with an attached energy dispersion type X-ray detector, for the content of Ti, Co and W at the points of 1–8 in FIGS. 7 and 8.

Figure 9:
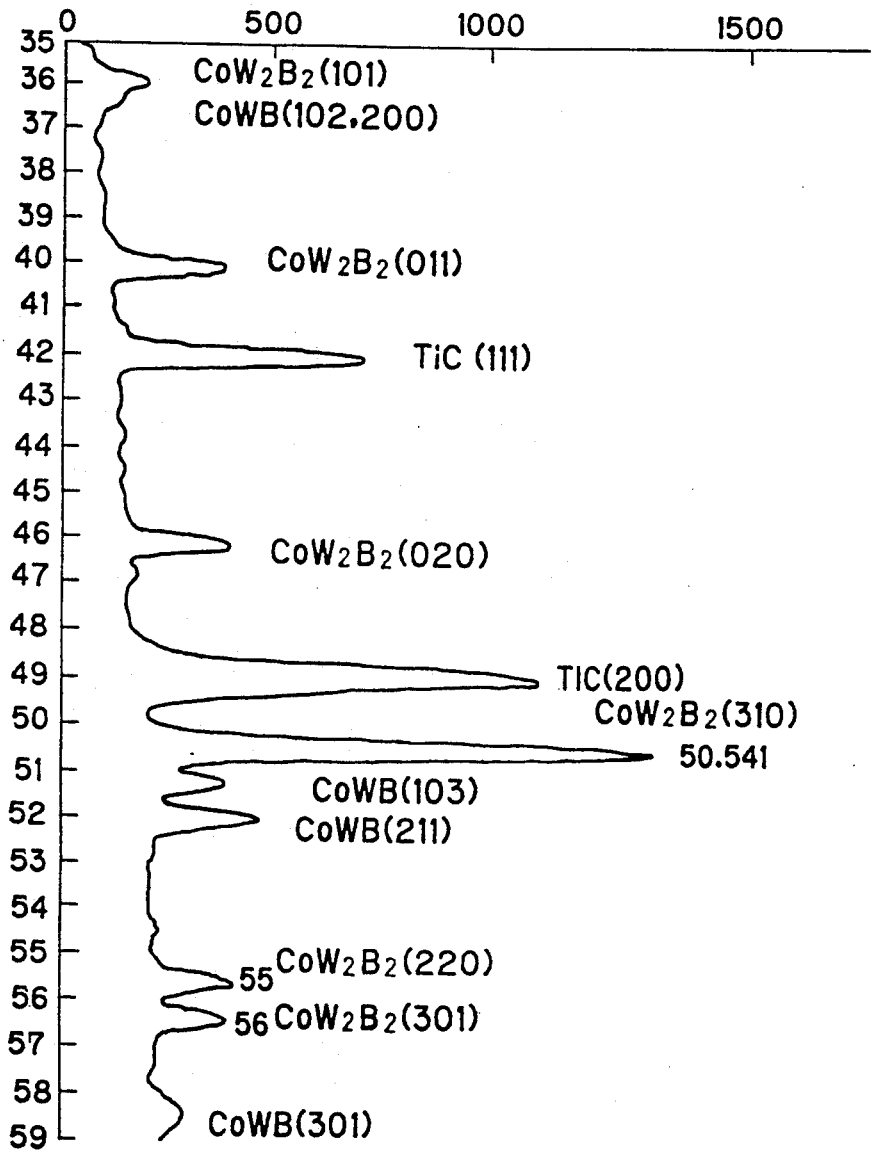
FIG. 9 shows the X-ray diffraction analysis of a cermet according to the invention.

FIG. 9 shows the result of X-ray analysis of the above cermet. From FIGS. 7, 8 and 9 and Table 5, it is seen that the composition of the respective phases of cermet in this example according to the invention were as follows:

(1) The TiC particle formed a composite core/shell structure having a core of TiC and a surface phase of (Ti,B)(B,C). The (Ti,W)(B,C) had a face-centered cubic structure similar to TiC and the diffraction peak of (Ti,W)(B,C) is overlapping in FIG. 9.

(2) The W-Co-B compound had a composite core/shell structure having a CoWB core and a surface phase of $CoW_2B_2$.

TABLE 5

| No. | Analysis Result (wt %) Ti | Co | W | Crystal Structure Tic Core | (Ti,W)(B,C) | CoWB core | $CoW_2B_2$ |
|---|---|---|---|---|---|---|---|
| 1 | 97 | 1.2 | 1.9 | ○ | | | |
| 2 | 58 | 1.5 | 40 | | ○ | | |
| 3 | 7.5 | 27 | 65 | | | | ○ |
| 4 | 55 | 3.5 | 41 | | ○ | | |
| 5 | 92 | 3.3 | 4.6 | ○ | | | |
| 6 | 84 | 2.9 | 13 | ○ | | | |
| 7 | 2.0 | 19 | 79 | | | ○ | |
| 8 | 5.5 | 35 | 60 | | | | |

When Co was increased, the crack resistance CR was slightly improved while Vickers hardness was reduced.

These results indicate that when Co/WB is restricted to a certain level, the volume of Co remaining in the form of metallic Co will be increased if the volume of Co is bigger than that of WB, and the deterioration of hardness will be more drastic than the improvement of crack resistance, because of the loss of the composite core/shell structure of W-Co-B. If WB is increased to more than the volume of Co, the metallic Co which does not react with WB is excessively reduced making sintering of a finer structure difficult.

TABLE 6

| | Blending Ratio (vol %) TiC | WB | Co | Analysis Value of Cermet (wt %) Ti | W | B | Co | C | Vickers Hardness | Crack Resistance |
|---|---|---|---|---|---|---|---|---|---|---|
| Example 4-1 | 85 | 10 | 5 | 51.0 | 26.7 | 0.8 | 7.0 | 14.5 | 1710 | 60 |
| Example 4-2 | 80 | 15 | 5 | 43.2 | 37.3 | 1.2 | 6.3 | 12.0 | 1800 | 44 |
| Example 4-3 | 75 | 20 | 5 | 20.0 | 61.6 | 1.4 | 6.1 | 10.9 | 2000 | 46 |
| Example 4-4 | 85 | 5 | 10 | 57.9 | 14.8 | 0.7 | 15.0 | 14.6 | 1640 | 63 |
| Example 4-5 | 80 | 10 | 10 | 49.4 | 23.2 | 1.2 | 13.7 | 12.5 | 1730 | 55 |
| Example 4-6 | 75 | 15 | 10 | 41.0 | 33.6 | 1.4 | 11.9 | 12.1 | 1810 | 51 |
| Example 4-7 | 70 | 20 | 10 | 34.1 | 42.6 | 1.8 | 11.5 | 10.0 | 1820 | 48 |
| Comparative Example | 80 | 0 | 20 | 55.8 | — | — | 30.0 | 14.2 | 1370 | 101 |

TABLE 7

| | Blending Ratio (vol %) TiC | WB | Co | Analysis Value of Cermet (wt %) Ti | W | B | Co | C | Vickers Hardness | Crack Resistance |
|---|---|---|---|---|---|---|---|---|---|---|
| Example 4-8 | 60 | 30 | 10 | 28.0 | 51.3 | 1.5 | 9.7 | 9.5 | 2020 | 40 |
| Example 4-9 | 60 | 20 | 20 | 28.6 | 41.3 | 1.4 | 20.6 | 8.1 | 1760 | 59 |
| Example 4-10 | 50 | 30 | 20 | 21.5 | 50.5 | 2.4 | 19.7 | 5.9 | 1870 | 51 |
| Example 4-11 | 40 | 40 | 20 | 15.6 | 57.6 | 3.1 | 17.5 | 6.2 | 1940 | 41 |
| Example 4-12 | 55 | 20 | 25 | 22.0 | 49.3 | 1.7 | 20.0 | 7.0 | 1610 | 71 |
| Example 4-13 | 45 | 30 | 25 | 17.3 | 51.6 | 2.0 | 24.0 | 5.1 | 1660 | 68 |
| Example 4-14 | 35 | 40 | 25 | 11.0 | 60.9 | 2.9 | 21.0 | 4.2 | 1680 | 66 |
| Comparative Example | 80 | 0 | 20 | 55.8 | — | — | 30.0 | 14.2 | 1370 | 101 |

EXAMPLE 4

After producing a cermet by the same process as used in Example 3, except for using the blending ratios in Tables 6 and 7, its Vickers hardness and crack resistance were measured.

The results are shown in Tables 6 and 7 together with the blending composition of this cermet. The unit of crack resistance (CR) is kg/mm.

These results demonstrate that the cermet in this example according to the invention had a high level of hardness and toughness. Also, when the volume of WB addition was increased, the Vickers hardness (Hv) was increased while crack resistance (CR) was decreased.

EXAMPLE 5

The Vickers hardness and crack resistance were measured after production of a cermet by the same process as in Example 3, except for using the blending volumes shown in Table 8.

TABLE 8

| Blending Ratio (vol %) WC | TiC | TaC | NbC | TiN | TiCN | WB | Co | Hv (1500° C.) | Hv (1525° C.) | Hv (1550° C.) | CR (1500° C.) | CR (1525° C.) | CR (1550° C.) |
|---|---|---|---|---|---|---|---|---|---|---|---|---|---|
| — | — | 60 | — | — | — | 30 | 10 | 1570 | 1770 | 1800 | 32 | 39 | 32 |
| — | — | — | 60 | — | — | 30 | 10 | 1770 | 1870 | 1850 | 26 | 33 | 30 |
| 50 | 10 | — | — | — | — | 30 | 10 | 2160 | 2045 | 2090 | 38 | 32 | 46 |
| 40 | 20 | — | — | — | — | 30 | 10 | 2055 | 2015 | 2060 | 39 | 31 | 39 |
| 30 | 30 | — | — | — | — | 30 | 10 | 1960 | 2000 | 2030 | 27 | 33 | 26 |
| 20 | 30 | — | — | — | — | 30 | 10 | 1930 | 1960 | 2000 | 25 | 36 | 29 |
| 10 | 20 | — | — | — | — | 30 | 10 | 2015 | 2040 | 1960 | — | 31 | 38 |
| 50 | — | 10 | — | — | — | 30 | 10 | 2140 | 2180 | 2150 | 43 | 40 | 37 |
| 55 | — | 5 | — | — | — | 30 | 10 | 2160 | 2210 | 2195 | 44 | 39 | 43 |
| 50 | — | — | 10 | — | — | 30 | 10 | 2170 | 2170 | 2160 | 41 | 42 | 40 |
| 55 | — | — | 5 | — | — | 30 | 10 | 2120 | 2100 | 2050 | 37 | 41 | 39 |
| — | — | — | — | — | 60 | 30 | 10 | 1820 | 1880 | 1890 | 40 | 43 | 41 |
| — | — | — | — | 60 | — | 30 | 10 | 1750 | 1810 | 1780 | 45 | 47 | 44 |

Table 8 shows the results together with blending composition of this cermet, which indicate a high level of hardness and toughness.

As demonstrated by the above results, the cermet alloy produced by the process according to the invention provides an excellent high level of hardness and also fine texture, as well as superior toughness of the product.

The invention has the advantage that a high density sintering process and product are attained under normal pressure, without relying upon HIP or hot pressing.

In addition, the cermet according to the invention provides excellent adhesion of a diamond film, for superior cutting tools.

While the invention has been described in detail and with reference to specific embodiments thereof, it will be apparent to one skilled in the art that various changes and modifications can be made therein without departing from the spirit and scope thereof.

What is claimed is:

1. A cermet alloy having a structure comprising a hard phase and a bonding phase, said hard phase comprising (1) at least one of MC MCN, wherein M is at least one element selected Ti, Zr, Hf, V, Nb, Ta, Cr, Mo, and W and (2) at least one W-Co-B compound; said bonding phase comprising Co.

2. A cermet alloy according to claim 1, wherein the metallic Co content of said bonding phase is at most 7.0 wt %.

3. The cermet alloy according to claim 1, wherein said hard phase further comprises at least one compound selected from (M,W)(B,C), (M,W)(B,N) and (M,W)(B,CN).

4. The cermet alloy according to claim 3, wherein said hard phase comprises core/shell composite particles having a core comprising at least one of MC, MN and MCN, said core having thereon at least a partial shell comprising at least one of (M,W)(B,C), (M,W)(B,N) and (M,W)(B,CN).

5. The cermet alloy according to claim 1, wherein said at least one W-Co-B compound is selected from CoWB and $CoW_2B_2$.

6. The cermet alloy according to claim 5, wherein said W-Co-B compound comprises core/shell particles having a core comprising $CoW_2B_2$, said core having thereon at least a partial shell comprising CoWB.

7. The cermet alloy according to claim 3, wherein said at least one W-Co-B compound is selected from CoWB and $CoW_2B_2$.

8. The cermet alloy according to claim 7, wherein said hard phase comprises core/shell composite particles having a core comprising at least one of MC, MN and MCN, said core having thereon at least a partial shell comprising at least one of (M,W)(B,C), (M,W)(B,N) and (M,W)(B,CN).

9. The cermet alloy according to claim 7, wherein said W-Co-B compound comprises core/shell particles having a core comprising $CoW_2B_2$, said core having thereon at least a partial shell comprising CoWB.

10. The cermet alloy according to claim 8, wherein said W-Co-B compound comprises core/shell particles having a core comprising $CoW_2B_2$, said core having thereon at least a partial shell comprising CoWB.

11. The cermet alloy according to claim 3, wherein M represents Ti and said hard phase comprises (1) TiC, (2) (Ti,W)(B,C) and (3) at least one W-Co-B compound.

12. The cermet alloy according to claim 11, wherein said hard phase comprises core/shell particles having a core comprising TiC, said core having thereon at least a partial shell comprising (Ti,W)(B,C).

13. The cermet alloy according to claim 5, wherein M represents Ti and said hard phase comprises TiC.

14. The cermet alloy according to claim 13, wherein said W-Co-B compound comprises core/shell particles having a core comprising $CoW_2B_2$, said core having thereon at least a partial shell comprising CoWB.

15. The cermet alloy according to claim 11, wherein said at least one W-Co-B compound is selected from CoWB and $CoW_2B_2$.

16. The cermet alloy according to claim 15, wherein said hard phase comprises core/shell particles having a core comprising TiC, said core having thereon at least a partial shell comprising (Ti,W)(B,C).

17. The cermet alloy according to claim 16, wherein said W-Co-B compound comprises core/shell particles having a core comprising $CoW_2B_2$, said core having thereon at least a partial shell comprising CoWB.

18. The cermet alloy according to claim 1, wherein M represents W and said hard phase comprises (1) WC and (2) at least one W-Co-B compound.

19. The cermet alloy according to claim 18, wherein the metallic Co content of said bonding phase is at most 3.5 wt %.

20. The cermet alloy according to claim 18, wherein said W-Co-B compound comprises (1) CoWB or (2) CoWB and $CoW_2B_2$.

21. A base plate for forming a diamond film thereon, said base plate comprising a sintered body having a structure comprising a hard phase and a bonding phase; said hard phase comprising (1) WC and (2) at least one W-Co-B compound; said bonding phase comprising Co, and the metallic Co content of the bonding phase being at most 2.0 wt %.

22. A diamond tool comprising a base plate and a diamond film on the surface of the base plate; said base plate comprising a sintered body having a structure comprising a hard phase and a bonding phase; said hard phase comprising (1) WC and (2) at least one W-Co-B compound; said bonding phase comprising Co, and the metallic Co content of the bonding phase being at most 2.0 wt %.

23. A method for producing a cermet alloy comprising the steps of:

(a) uniformly mixing (1) 10 to 45 vol % of a powder comprising WB; (2) 5 to 20 vol % of a powder comprising Co; and (3) the balance being a powder comprising at least one of MC, MN and MCN, wherein M is at least one element selected from Ti, Zr, Hf, Th, V, Nb, Ta, Pa, Cr, Mo, U and W;

(b) forming the mixture into green body; and (c) sintering the green body at a temperature of 1,300 to 1,600 ° C. for 10 to 120 minutes.

24. The method for producing a cermet alloy according to claim 23, wherein M represents Ti and said hard phase comprises TiC.

25. The method for producing a cermet alloy according to claim 23, wherein M represents W and said hard phase comprises WC.

26. The cermet alloy as claimed in claim 1, wherein M represents at least one element selected from Ti, W, Mo, Ta and Nb.

* * * * *